US008238775B2

(12) United States Patent
Ohashi

(10) Patent No.: US 8,238,775 B2
(45) Date of Patent: Aug. 7, 2012

(54) IMAGE HEATING APPARATUS

(75) Inventor: Eijiro Ohashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 300 days.

(21) Appl. No.: 12/753,223

(22) Filed: Apr. 2, 2010

(65) Prior Publication Data

US 2010/0266306 A1 Oct. 21, 2010

(30) Foreign Application Priority Data

Apr. 17, 2009 (JP) ..... 2009-100762

(51) Int. Cl.
*G03G 15/20* (2006.01)

(52) U.S. Cl. ..... 399/69; 399/70

(58) Field of Classification Search ..... 399/69, 399/70, 328, 334
See application file for complete search history.

(56) References Cited

U.S. PATENT DOCUMENTS 5,742,865 A * 4/1998 Yajima et al. ..... 399/69
2001/0017992 A1* 8/2001 Hayashi et al. ..... 399/69
2006/0165428 A1* 7/2006 Hasegawa ..... 399/69

FOREIGN PATENT DOCUMENTS

JP 11-002988 A 1/1999
JP 2001-282036 A 10/2001

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

The non-sheet-feeding portion temperature rise is reduced during warm-up operation of an image heating apparatus, the time needed for the warm-up operation is reduced, and the accuracy of the image fixing operation is improved. When a CPU determines that a temperature detected by an end portion thermistor is higher than a temperature detected by a center portion thermistor, the CPU controls the temperature of a fixing heater based on a detection result of the end portion thermistor. When the CPU determines that the temperature detected by the end portion thermistor is equal to or less than the temperature detected by the center portion thermistor, the CPU controls the temperature of the fixing heater based on a detection result of the center portion thermistor.

2 Claims, 11 Drawing Sheets

IMAGE HEATING APPARATUS

BACKGROUND OF THE INVENTION

1. Field of the Invention

The present invention relates to an image heating apparatus preferably used as a toner image fixing apparatus of an image forming apparatus such as a copier, a laser beam printer, and a facsimile machine.

The image heating apparatus referred to herein includes not only a fixing apparatus for heating and fixing an unfixed image onto a recording material as a permanent image but also an apparatus for temporarily fixing an unfixed image onto a recording material and an apparatus for improving the quality of the surface nature of image such as gloss by reheating a recording material carrying an image thereon.

2. Description of the Related Art

There is an image forming apparatus in which an unfixed toner image corresponding to image information as an object is formed and borne on a surface of a recording material with toner (developer) by direct or indirect transfer methods by means of an appropriate one of image forming process means. Examples of the image forming process means include electrophotography, electrostatic recording, magnetic recording, and the like. It should be noted that the toner is made of hot-melt resin and the like. Examples of the recording material include paper, printing paper, a transfer material sheet, an OHT sheet, gloss paper, a gloss film, electrofax paper, electrostatic recording paper, and the like.

The above image forming apparatus includes a fixing apparatus serving as an image heating apparatus for heating and fixing an unfixed toner image onto a surface of a recording material as a permanently-fixed image. A heat roller-type fixing apparatus and a film (belt)-type fixing apparatus are often used as the fixing apparatus. The film (belt)-type fixing apparatus has a shorter warm-up time than the heat roller-type fixing apparatus, and operates on demand and is cheaper. It should be noted that the warm-up time is a time from when the fixing apparatus begins driving or from when the fixing apparatus is in standby state to when the fixing apparatus reaches a temperature needed for heating/fixing processing.

A so-called "non-sheet-feeding portion temperature rise" phenomenon occurs in the above fixing apparatus. This is a phenomenon that occurs when the fixing apparatus is fed with a small size recording material having a smaller sheet width than a large size recording material having the maximum sheet width that can be fed in the fixing apparatus, and this phenomenon occurs for the following reasons. In a non-sheet-feeding portion of a fixing nip portion corresponding to a differential portion of sheet width between the large size recording material and the small size recording material, heat is not consumed for heating the recording material but is only accumulated, so that the amount of accumulated heat in the non-sheet-feeding portion of the fixing nip portion increases as the small size recording material is successively fed. Accordingly, the temperature of a sheet-feeding portion of the fixing nip portion is adjusted to and maintained at a predetermined fixing temperature, whereas the temperature of the non-sheet-feeding portion increases to a temperature higher than the predetermined fixing temperature. At this occasion, the sheet width of the recording material is the size of the recording material in a direction perpendicular to the conveyance direction of the recording material on the plane of the recording material.

When the above non-sheet-feeding portion temperature rises to a temperature higher than an allowable temperature, a thermal damage trouble occurs on constituent members of the fixing apparatus, which deteriorates the durability. Alternatively, in a case where a large size recording material is fed when the non-sheet-feeding portion temperature excessively rises in the fixing apparatus due to successive feeding of small size recording materials, an end portion hot offset and the like may occur due to an excessively high temperature in the non-sheet-feeding portion temperature rise region of the fixing nip portion.

In order to avoid the problem caused by the above non-sheet-feeding portion temperature rise, the fixing apparatus is configured to be provided with a temperature detection element that detects the temperature of the non-sheet-feeding portion. For example, Japanese Patent Application Laid-Open No. 2001-282036 discloses that the temperature detection element is arranged to detect the temperature of the non-sheet-feeding portion, and when the non-sheet-feeding portion temperature detected by this temperature detection element exceeds a predetermined allowable maximum temperature, the control is performed as follows. That is, sheet feeding operation and image forming operation of an image forming apparatus is controlled to be in a temporary halted state, cooling operation is performed, and when the above non-sheet-feeding portion temperature detected by the temperature detection element decreases to a temperature equal to or less than a certain value, the control is performed so as to resume the halted image forming operation. On the other hand, for example, Japanese Patent Application Laid-Open No. H11-002988 discloses that a temperature control is performed using a temperature detection element of a non-sheet-feeding portion during warm-up process of a fixing apparatus, and when the temperature detection element of the non-sheet-feeding portion reaches a predetermined temperature, the temperature control is performed using a temperature detection element of a sheet-feeding portion. The configuration of Japanese Patent Application Laid-Open No. H11-002988 prevents an increase in the warm-up time.

Since an image to be fixed by the image heating apparatus resides on a recording material, it is necessary to control the temperature of the fixing apparatus based on the temperature detection element of the image region (sheet-feeding portion) in order to heat and fix a high quality image.

Now, the problem to be solved by the present invention will be explained using FIG. 13 and FIG. 14. FIG. 13 and FIG. 14 are time charts for explaining the temperature control of the fixing apparatus. When the temperature control is performed based on the temperature detection element of the sheet-feeding portion, and the warm-up process starts from a state in which the fixing apparatus is sufficiently cooled down, the temperature reaches a target temperature Tt while a difference between a temperature T1 of the sheet-feeding portion (thick solid line) and a temperature T2 of the non-sheet-feeding portion (thin solid line) is still small as shown in FIG. 13. Since the temperature control close to the target temperature Tt can be performed, the above-described problem caused by the non-sheet-feeding portion temperature rise does not occur.

However, after small size recording materials are successively fed, the temperature of the non-sheet-feeding portion becomes higher than that of the sheet-feeding portion. When the temperature control is performed based on the temperature detection element of the sheet-feeding portion at this occasion, the temperature T2 (thin solid line) of the non-sheet-feeding portion becomes higher as shown in FIG. 14, which causes a problem of temperature increase in the non-sheet-feeding portion as described above. In general, a fixing apparatus has an element (such as a safety circuit) to stop heating operation when the temperature reaches a predetermined temperature or more in order to prevent an excessively high temperature. When a detection result of the temperature detection element of the non-sheet-feeding portion indicates that the temperature has reached a temperature Ts at which the safety circuit is activated, there may occur a problem in that the operation of the fixing apparatus is stopped by the activation of the safety circuit at a point A in FIG. 14.

However, the temperature control using the temperature detection element of the non-sheet-feeding portion entails stopping of image forming operation, and accordingly, it takes a longer time to fix an image. Therefore, the configuration of always performing warm-up operation using the temperature detection element of the non-sheet-feeding portion can avoid the problem caused by the non-sheet-feeding portion temperature rise but still has a problem in that it takes a longer time to fix an image.

SUMMARY OF THE INVENTION

The present invention has been made in view of the above problem. A purpose of the present invention is to provide an image heating apparatus that can suppress excessive temperature rise in the non-sheet-feeding portion even when warm-up operation starts while the temperature of the non-sheet-feeding portion is higher than that of the sheet-feeding portion.

Another purpose of the present invention is to provide an image heating apparatus that can suppress excessive temperature rise in the non-sheet-feeding portion while preventing increase in the time of warm-up operation even when warm-up operation starts while the temperature of the non-sheet-feeding portion is higher than that of the sheet-feeding portion.

Still another object of the present invention is to provide an image heating apparatus including: a heat member that heats an image on a recording material; a pressure member that forms a nip portion for pinch and convey the recording material with the heat member; a first temperature detection element that detects a temperature of the heat member in a region for feeding a recording material having the smallest size which can be used by the image heating apparatus, in a direction perpendicular to a conveyance direction of the recording material; a second temperature detection element that detects a temperature of the heat member in a region outside of the region for feeding the recording material having the smallest size in the direction perpendicular to the conveyance direction of the recording material; and a control part that controls power supplied to the heat member, wherein in a heating process period during which the image is heated by the nip portion, the control part controls the power supplied to the heat member such that a temperature detected by the first temperature detection element keeps a target temperature, wherein in a warm-up period in which the power is supplied to the heat member so that the temperature of the heat member reaches the target temperature, in a case where the temperature detected by the second temperature detection element is higher than the temperature detected by the first temperature detection element, the control part controls the power supplied to the heat member so that the temperature detected by the second temperature detection element reaches the target temperature, and until the temperature detected by the first temperature detection element reaches the target temperature after the temperature detected by the second temperature detection element reaches the target temperature, the control part controls the power supplied to the heat member so that the temperature detected by the second temperature detection element keeps the target temperature.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. However, constituent elements described in these embodiments are examples, and it is to be understood that the scope of the present invention should not be limited thereto unless otherwise specified.

First Embodiment

Figure 1:
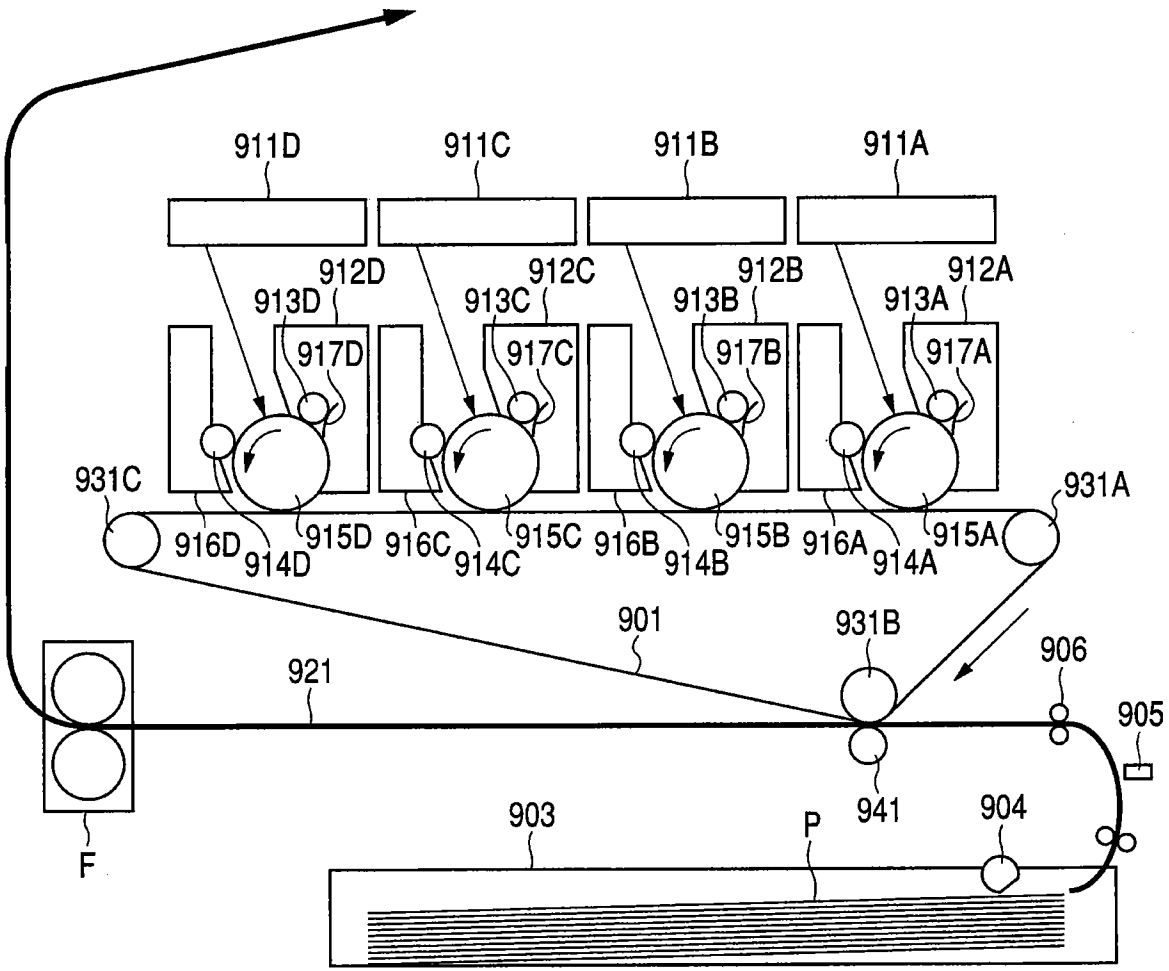
FIG. 1 is a schematic configuration diagram showing an image forming apparatus according to first to fifth embodiments.

FIG. 1 shows a schematic cross-sectional diagram showing an image forming apparatus including an image heating apparatus according to the present invention. Examples of the image forming apparatus include a laser beam printer and a copier employing electrophotographic and other recording methods. In the following explanation, a laser beam printer will be described as an example of the image forming apparatus.

<Structure of Image Forming Apparatus>

The image forming apparatus shown in FIG. 1 is provided with four image forming portions respectively for yellow, magenta, cyan, and black. In the following explanation, reference symbols A, B, C, and D denote portions for yellow, magenta, cyan, and black, respectively.

Each of the image forming portions includes charge portions 913A, 913B, 913C, 913D for uniformly charging image bearing members, i.e., photosensitive drums 915A, 915B, 915C, 915D, to a predetermined potential. The photosensitive drums 915A, 915B, 915C, 915D rotate in a counter-clockwise direction (direction indicated by an arrow in the figure).

In addition, the image forming portion includes laser scanner units 911A, 911B, 911C, 911D for forming electrostatic latent images on the charged photosensitive drums 915A, 915B, 915C, 915D by emitting laser lights corresponding to image data of respective colors. In addition, the image forming portion includes developing units 916A, 916B, 916C, 916D for developing electrostatic latent images formed on the photosensitive drums 915A, 915B, 915C, 915D and visualizing making the electrostatic latent images. Sleeve rollers 914A, 914B, 914C, 914D for feeding developers of respective colors to the photosensitive drums 915A, 915B, 915C, 915D are arranged in the developing units 916A, 916B, 916C, 916D. Further, the image forming portion includes cleaning units 917A, 917B, 917C, 917D for removing developers remaining on the photosensitive drums 915A, 915B, 915C, 915D after the developers are transferred. In addition, residual developer units 912A, 912B, 912C, 912D are arranged to contain the developers removed by the cleaning units 917A, 917B, 917C, 917D (hereinafter referred to as residual developer).

An intermediate transfer belt unit, i.e., an intermediate transfer body unit, is arranged to face the image forming portion. This intermediate transfer belt unit includes an intermediate transfer belt 901, i.e., an intermediate transfer body, and the images formed on the photosensitive drums 915A, 915B, 915C, 915D by the above method are primarily transferred onto the intermediate transfer belt 901. This intermediate transfer belt 901 includes a drive roller 931C for driving the intermediate transfer belt 901, a tension roller 931A for applying tension to the intermediate transfer belt 901, and a transfer unit 941 for secondarily transferring the image onto a recording material P. Numeral 931B denotes a transfer unit-facing roller. The intermediate transfer belt 901 moves in a clockwise direction (direction indicated by an arrow in the figure).

A sheet feeding cassette 903 containing the recording materials P is arranged at a lower section of the image forming apparatus. A conveyance path 921 of the recording material P is provided with a feeding roller 904 for feeding the recording material P and a sheet leading edge position detection sensor 905 for detecting the leading edge of the recording material P and coordinating timing of image forming process. In addition, the conveyance path 921 is provided with a registration roller 906 for causing the recording material P to wait in order to coordinate the timing according to which the images formed on the photosensitive drums 915A, 915B, 915C, 915D are transferred onto the intermediate transfer belt 901.

The images formed on the intermediate transfer belt 901 are transferred onto the recording material P by the transfer unit 941. A fixing apparatus F, i.e., image heating apparatus, pressurizes and heats the four color developer images transferred on the recording material P so as to fuse and fix the four color developer images, and thereafter, the recording material P having the image fixed thereon is discharged out of the apparatus. In this manner, the image forming operation is finished.

Figure 2:
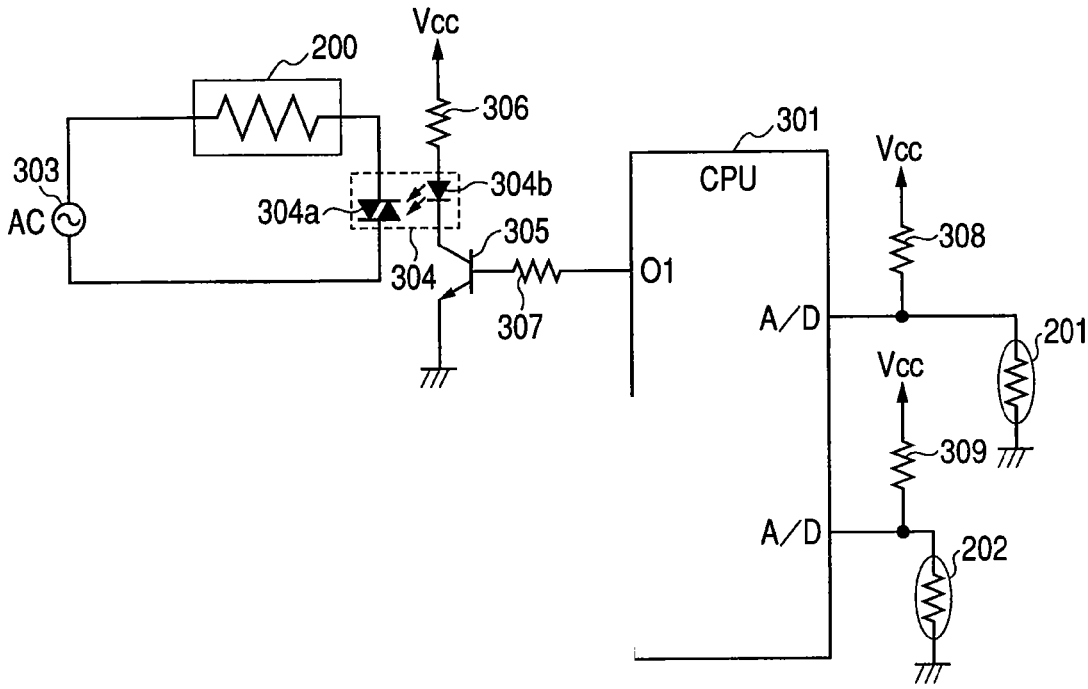
FIG. 2 is a circuit diagram of a control system according to the first to fifth embodiments.

FIG. 2 shows a power supply circuit supplying power to a heater 200 of the image heating apparatus and a control circuit for controlling supply of power to the heater 200.

Numeral 301 denotes a CPU. Numeral 303 denotes an AC power supply (commercial power). Numeral 304 denotes a photo triac coupler. Numeral 305 denotes a transistor. Numerals 306 to 309 denote resistors. Detection results of a later-mentioned center portion thermistor 201 and a later-mentioned end portion thermistor 202 are input into an A/D port of the CPU 301, and detected voltages are converted into digital temperature data. The transistor 305 is connected to an output port O1 of the CPU 301, and drives the photo triac coupler 304.

When an LED 304*b* of the photo triac coupler 304 is turned on, the photo triac 304*a* becomes conductive, and an AC current flows to the heater 200.

<Structure of Fixing Apparatus>

Figure 3:
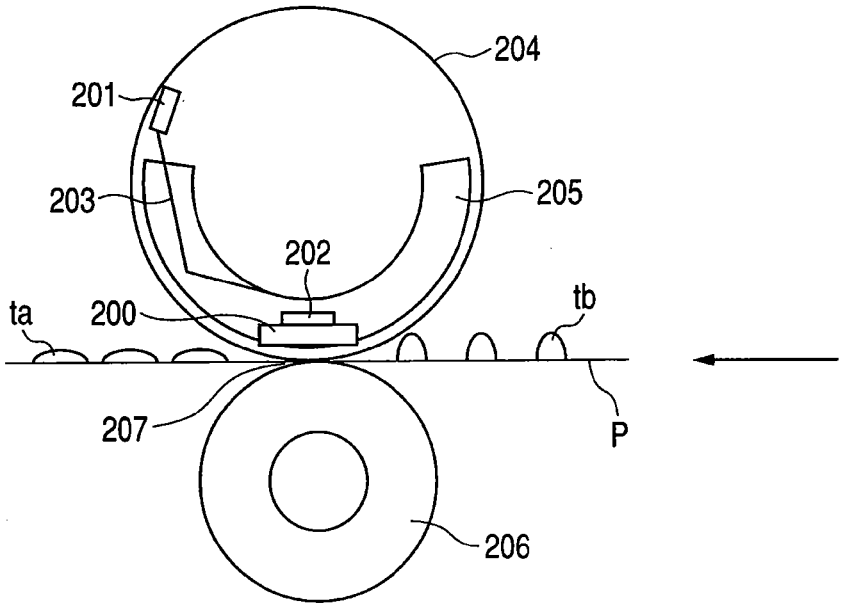
FIG. 3 is a schematic cross-sectional diagram showing a fixing apparatus according to the first to third embodiments.

FIG. 3 is a schematic cross-sectional diagram showing a fixing apparatus F according to the present embodiment. The fixing apparatus F according to the present embodiment is a heating film type apparatus.

The fixing apparatus F includes a fixing heater 200 and a fixing film 204 serving as a heating film sliding on the fixing heater 200. In this embodiment, the fixing heater 200 is the heater 200 explained in FIG. 2. The heater 200 and the heating film 204 constitute a heat member. In addition, the fixing apparatus F includes a center portion thermistor 201 serving as a first temperature detection element arranged in contact with the fixing film 204 and an end portion thermistor 202 serving as a second temperature detection element arranged in contact with the fixing heater 200. The fixing heater 200 is arranged along a longitudinal direction of a fixing heater holder 205 (a direction in parallel with a rotational axis of the fixing film 204 or a direction perpendicular to the conveyance direction of the recording material P) on a lower surface of the fixing heater holder 205. The fixing film 204 is loosely fitted around the fixing heater holder 205. The center portion thermistor 201 is held by a thermistor arm 203 attached to the fixing heater holder 205 so as to be in contact with the fixing film 204. The end portion thermistor 202 is held by the fixing heater holder 205 so as to be in contact with the fixing heater 200.

The fixing apparatus F includes a pressure roller 206 serving as a pressure member, and the pressure roller 206 and the fixing heater 200 form a nip portion via the fixing film 204. The pressure roller 206 cooperates with the fixing heater 200 so as to form a fixing nip portion 207 via the fixing film, 204. The recording material P is conveyed in the direction indicated by the arrow in the figure, and an unfixed developer tb on the recording material P is heated and fixed at the fixing nip portion 207 to become a fixed developer ta.

Figure 4:
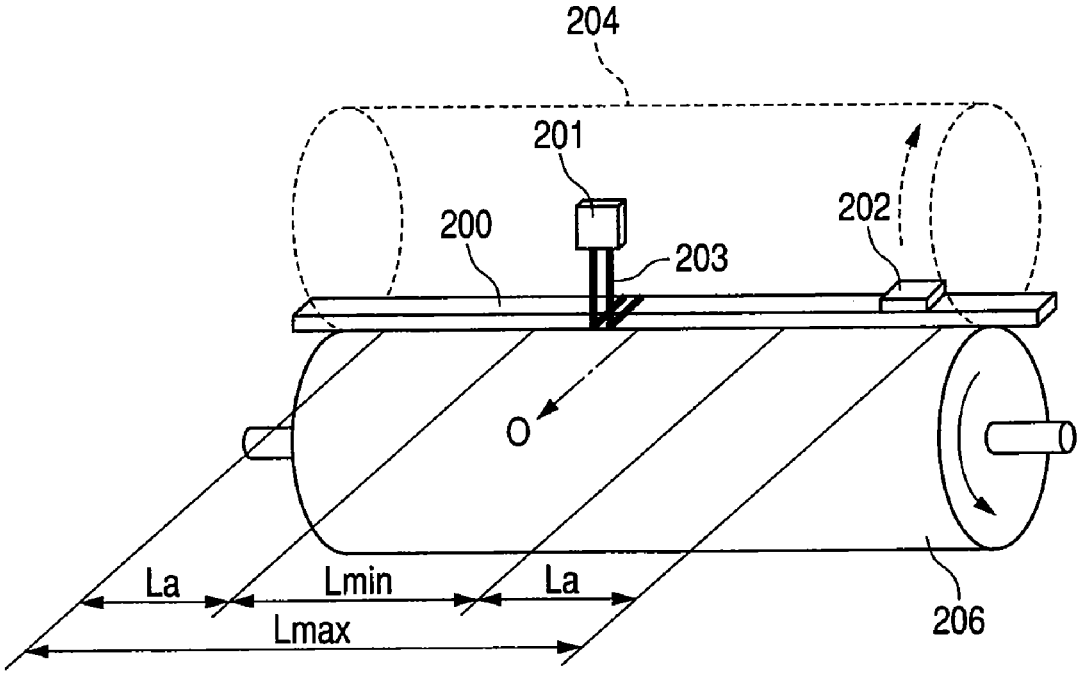
FIG. 4 is a schematic perspective view showing a fixing apparatus according to the first to third embodiments.

FIG. 4 is a schematic perspective view showing positional relationship among the fixing heater 200, the fixing film 204 (indicated by a broken line), the center portion thermistor 201, the end portion thermistor 202, and the pressure roller 206. In the present embodiment, the recording material P is fed based on a central reference so that the widthwise center of the recording material P moves along the widthwise center of the conveyance path. An arrow O (alternate long and short dashed line) indicates a sheet feeding reference line and a sheet feeding direction (conveyance direction) of the recording material P.

Lmax denotes a sheet-feeding portion of a large size recording material having the maximum sheet width that can be fed in the image forming apparatus (and the image heating apparatus) (large size sheet-feeding portion). Lmin denotes a sheet-feeding portion of a small size recording material having a sheet width smaller than that of the large size recording material having the maximum sheet width (small size sheet-feeding portion). The small size sheet-feeding portion Lmin of FIG. 4 represents the sheet-feeding portion of the recording material having the minimum sheet width that can be fed in the image forming apparatus. La represents a non-sheet-feeding portion that arises when the small size recording material is fed (a difference region between the large size sheet-feeding portion and the small size sheet-feeding portion). It should be noted that the heater 200 is made by screen-printing one heating resistor body onto a ceramic substrate. The length of the heater 200 in the longitudinal direction (widthwise direction of the recording material) is longer than Lmax as shown in FIG. 4, and the length of the heating resistor body in the longitudinal direction (widthwise direction of the recording material) is substantially the same as Lmax. The resistor value of the heating resistor body per unit length in the longitudinal direction of the heater is constant, and the heating distribution of the heating resistor body is flat in the longitudinal direction of the heater.

The center portion thermistor 201 is a temperature detection element for detecting the temperature of the heat member corresponding to the section within the small size sheet-feeding portion Lmin of the recording material having the minimum sheet width serving as a common sheet-feeding portion for recording materials of all kinds of sheet widths that can be fed in the image forming apparatus. In the present embodiment, this center portion thermistor 201 is arranged to be in elastic contact with the fixing film 204 corresponding to the section within the small size sheet-feeding portion Lmin of the recording material having the minimum sheet width, so as to detect the temperature of the inner surface of the fixing film 204. In other words, the center portion thermistor 201 is attached to an end of the thermistor arm 203 fixedly supported by the fixing heater holder 205, so that the thermistor arm 203 swings elastically. Even when movement of the inner surface of the fixing film 204 becomes unstable, the center portion thermistor 201 is always in contact with the inner surface of the fixing film 204.

The end portion thermistor 202 is a temperature detection element for detecting the temperature of the heat member corresponding to the section within the non-sheet-feeding portion La when the small size recording material is fed, and the end portion thermistor 202 is arranged at a position close to an end portion of the fixing heater 200 within the large size sheet-feeding portion Lmax. This end portion thermistor 202 is arranged at a position closer to the fixing heater 200 with respect to the center portion thermistor 201. In the present embodiment, the end portion thermistor 202 is arranged to be in contact with the back surface at a position close to an end portion of the fixing heater 200, and detects the temperature of the back surface of the fixing heater 200.

The center portion thermistor 201 and the end portion thermistor 202 are connected to the CPU 301 (see FIG. 2) of the control circuit unit serving as the control part of the image forming apparatus. The CPU 301 of this control circuit unit decides the contents of temperature adjustment control of the fixing apparatus F, based on the outputs of the center portion thermistor 201 and the end portion thermistor 202. Then, the CPU 301 of the control circuit unit controls driving of the heater drive circuit unit (the photo triac coupler 304, transistor 305, and the like of FIG. 2), so as to control power supplied to the fixing heater 200.

In normal use, as soon as the pressure roller 206 of the fixing apparatus F starts to rotate, the fixing film 204 is driven and begins to rotate. As the temperature of the fixing heater 200 rises, the temperature of the inner surface of the fixing film 204 increases accordingly. The supply of power to the fixing heater 200 is controlled such that the input power to the heater 200 is controlled so as to cause the temperature of the inner surface of the fixing film 204, i.e., the temperature detected by the center portion thermistor 201, to be a predetermined temperature.

Temperature Control of Fixing Apparatus According to the Present Embodiment

Figure 5:
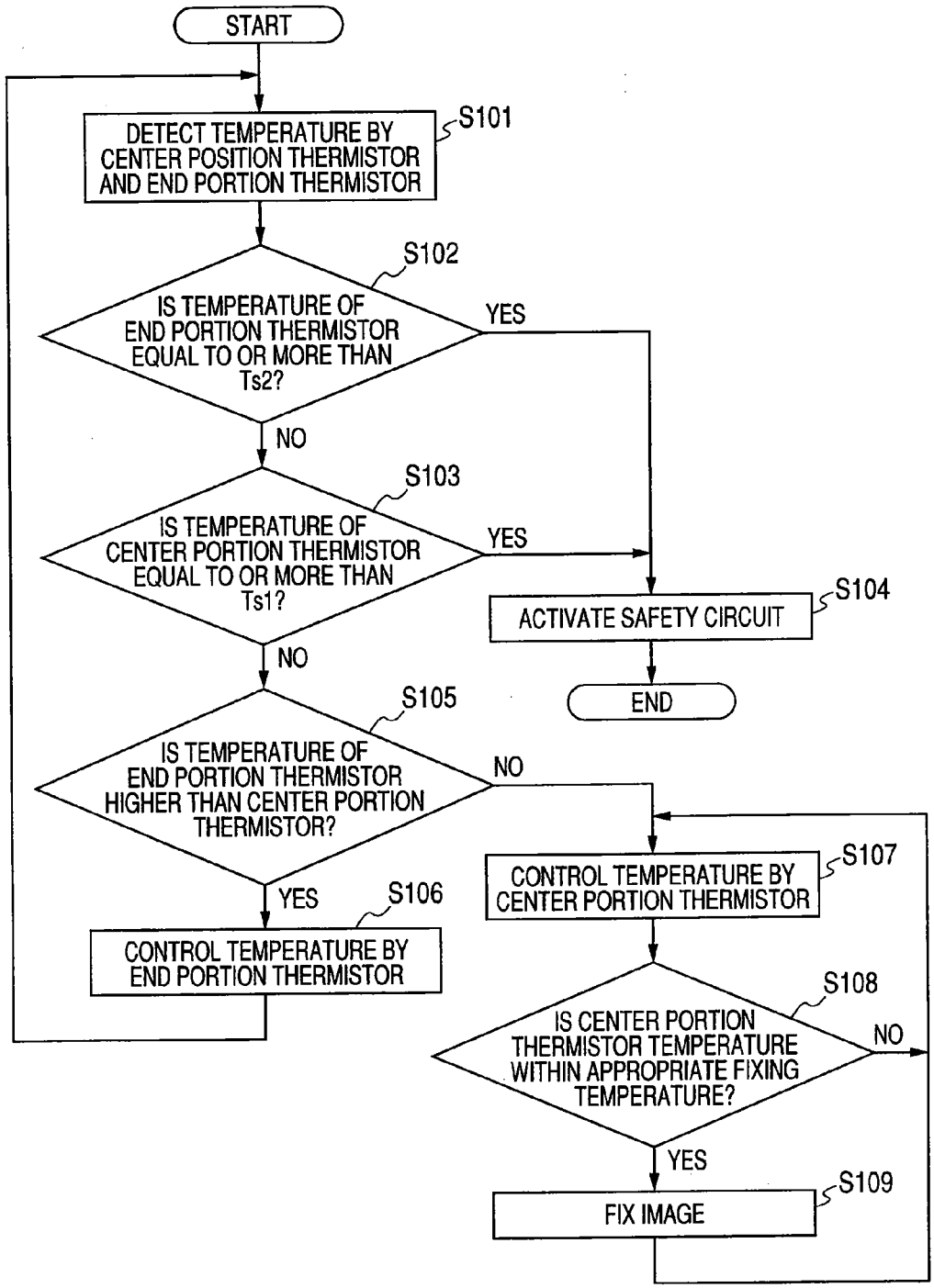
FIG. 5 is a flowchart showing a temperature control according to the first embodiment.

FIG. 5 is a flowchart showing print operation control according to the present embodiment. This print operation control is executed based on the outputs of the center portion thermistor 201 and the end portion thermistor 202 by the CPU 301 of the control circuit unit.

When print operation starts (START), the CPU 301 causes the center portion thermistor 201 and the end portion thermistor 202 to detect the temperatures at the center portion and the end portion of the fixing apparatus F (step 101 (hereinafter abbreviated as S101)). When the CPU 301 determines that the temperature at the end portion detected by the end portion thermistor 202 is equal to or more than a safety circuit activation temperature Ts2 (degrees) (Yes in S102), the CPU 301 activates the safety circuit (not shown) (S104) so as to stop print operation (END).

When the CPU 301 determines in S102 that the temperature detected by the end portion thermistor 202 is less than the safety circuit activation temperature Ts2, it is moved to the determination of S103. When the CPU 301 determines that the temperature of the center portion detected by the center portion thermistor 201 is equal to or more than a safety circuit activation temperature Ts1 (If yes in S103), the CPU 301 also activates the safety circuit (S104) so as to stop print operation (END). The safety circuit is installed to prevent thermal damage trouble of the fixing apparatus F caused by temperature rise of the fixing apparatus F. Each of the safety circuit activation temperatures Ts1, Ts2 is set to the allowable maximum increased temperature at which no thermal damage trouble is caused to the fixing apparatus F or a temperature less than the allowable maximum temperature and close to the allowable maximum temperature.

When the CPU 301 determines in S103 that the temperature detected by the center portion thermistor 201 is less than the safety circuit activation temperature Ts1, it is moved to the determination of S105. When the CPU 301 determines that the temperature detected by the end portion thermistor 202 is equal to or less than the temperature detected by the center portion thermistor 201 (No in S105), the program proceeds to the processing of S107. The CPU 301 controls the temperature of the fixing apparatus F based on the temperature detected by the center portion thermistor 201, and performs temperature control (or temperature adjustment) by causing the heater drive circuit unit to control power supplied to the fixing heater 200 so as to cause the temperature detected by the center portion thermistor 201 to be the target temperature Tt (S107). When the CPU 301 determines that the temperature detected by the center portion thermistor 201 is within an appropriate fixing temperature range (Yes in S108), the recording material P is conveyed to the fixing nip portion 207, and the fixing apparatus F performs heating and fixing processing (image fixing) on the unfixed image on the recording material P (S109).

When the CPU 301 determines in S108 that the temperature detected by the center portion thermistor 201 is not within the appropriate fixing temperature range, S107 and S108 are repeated until the detected temperature falls within the appropriate fixing temperature range.

When the CPU 301 determines in S105 that the temperature detected by the end portion thermistor 202 is more than the temperature detected by the center portion thermistor 201, the program proceeds to the processing of S106. The CPU 301 controls the temperature of the fixing apparatus F based on the temperature detected by the end portion thermistor 202, and performs temperature control by causing the heater drive circuit unit to control power supplied to the fixing heater 200 so as to cause the temperature detected by the end portion thermistor 202 to be the target temperature Tt (S106). Thereafter, the processing performed by the CPU 301 returns to S101.

While the CPU 301 performs the temperature control based on the result detected by the end portion thermistor 202, the temperature detected by the center portion thermistor 201 increases. Then, when the CPU 301 determines that the temperature detected by the end portion thermistor 202 is equal to or less than the temperature detected by the center portion thermistor 201 (No in S105), the temperature of the fixing apparatus F is controlled based on the temperature detected by the center portion thermistor 201. In other words, the CPU 301 proceeds to such temperature control operation as to cause the temperature detected by the center portion thermistor 201 to be the target temperature Tt (S107).

The target temperature Tt is a temperature appropriate for image fixing operation. When the temperature detected by the center portion thermistor 201 reaches the target temperature Tt or falls within the appropriate fixing temperature range close to the target temperature Tt, the fixing apparatus F starts image fixing operation. When the temperature detected by the center portion thermistor 201 has not reached the target temperature Tt, or when the temperature detected by the center portion thermistor 201 has not fallen within the appropriate fixing temperature range close to the target temperature, the CPU 301 controls the image forming apparatus to temporarily stop the sheet feeding operation and image forming operation. Then, the CPU 301 waits until the temperature detected by the center portion thermistor 201 of the fixing apparatus F increases to a temperature within the appropriate fixing temperature range.

Figure 6:
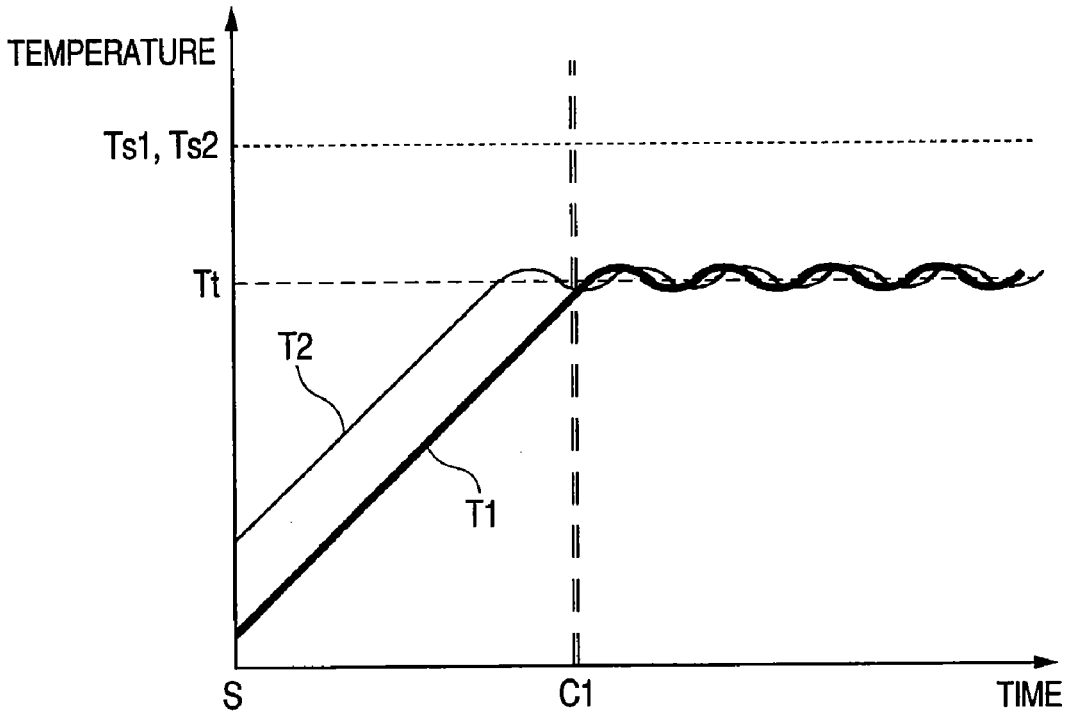
FIG. 6 is a time chart showing the temperature control according to the first embodiment.

Time Chart of Temperature Control of Fixing Apparatus According to the Present Embodiment FIG. 6 is a time chart showing relationship between time and temperatures detected by the center portion thermistor 201 and the end portion thermistor 202 when this control is performed. In FIG. 6, the temperature detected by the center portion thermistor 201 is denoted by T1 (thick solid line), and the temperature detected by the end portion thermistor 202 is denoted by T2 (thin solid line). FIG. 6 shows a case where a small size recording material is fed right before the temperature control according to the print operation shown in this time chart is performed, and at the start of fixing temperature adjustment operation (time S), the temperature T2 detected by the end portion thermistor 202 becomes higher than the temperature T1 detected by the center portion thermistor 201. Since the temperature T2 detected by the end portion thermistor 202 is higher than the temperature T1 detected by the center portion thermistor 201 (Yes in S105 of FIG. 5), the CPU 301 performs temperature control so as to cause the temperature detected by the end portion thermistor 202 to be the target temperature Tt at the start of the temperature control operation (S106 of FIG. 5). Since the temperature detected by the center portion thermistor 201 becomes higher than the temperature detected by the end portion thermistor 202 at the position of the time C1 (No in S105 of FIG. 5), the CPU 301 switches the temperature control target from the detection result of the end portion thermistor 202 to the detection result of the center portion thermistor 201 (S107 of FIG. 5). At a position after the time C1, the CPU 301 performs the temperature control so as to cause the temperature detected by the center portion thermistor 201 to be the target temperature Tt. A period before the time C1 is a warm-up period. A heat processing period exists after the time C1. As described above, in the present embodiment, when the temperature detected by the second temperature detection element is higher than the temperature detected by the first temperature detection element in the warm-up period during which power is supplied to the heat member so as to cause the temperature of the heat member to reach the target temperature, the control part controls the power supplied to the heat member so as to cause the temperature detected by the second temperature detection element to reach the target temperature. From when the temperature detected by the second temperature detection element reaches the target temperature to when the temperature detected by the first temperature detection element reaches the target temperature, the control part controls the power supplied to the heat member so as to cause the temperature detected by the second temperature detection element to maintain the target temperature.

Figure 14:
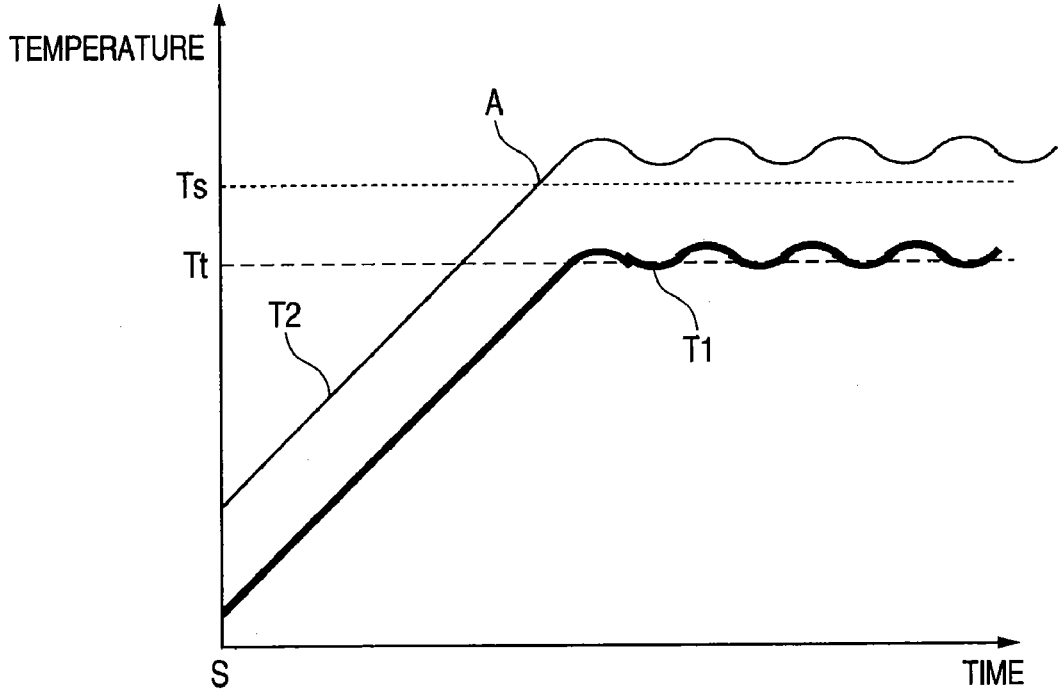
FIG. 14 is a time chart showing the temperature control according to the comparative example.

In the conventional configuration, the temperature of the fixing apparatus F is controlled based on the result detected by the center portion thermistor 201 when the image forming apparatus is turned on or starts print operation. In the conventional configuration, there is a problem in that the temperature at the end of the fixing apparatus F increases to an excessively high temperature as shown in FIG. 14. For this reason, warm-up operation is controlled so as to suppress the power input to the fixing heater 200 (heater input power) in order to prevent an excessively high temperature at the end portion of the fixing apparatus F, which entails the problem in that it takes a longer time to perform the warm-up operation. In the present embodiment, when the temperature at the end portion of the fixing apparatus F is high, the warm-up operation is performed by performing such temperature control as to cause the temperature detected by the end portion thermistor 202 to be the target temperature Tt, and therefore, the image forming apparatus can operate more efficiently in a shorter time period. In addition, after the temperature detected by the center portion thermistor 201 becomes equal to or more than the temperature detected by the end portion thermistor 202, the temperature control is switched to the one based on the temperature detected by the center portion thermistor 201, so that the temperature is controlled based on the center portion thermistor 201. Therefore, the quality of the fixed image improves.

As described above, in the present embodiment, the temperature control during the warm-up operation can be performed based on the temperature detected by the end portion thermistor 202. Therefore, the non-sheet-feeding portion temperature rise can be reduced during the warm-up operation of the fixing apparatus F, and in addition, it is possible to reduce the time needed for the warm-up operation and to improve the accuracy of the image fixing operation.

Second Embodiment

In the second embodiment, even when the temperature detected by the end portion thermistor is higher than the temperature detected by the center portion thermistor, the temperature control is performed based on the temperature detected by the center portion thermistor as long as the temperature detected by the center portion thermistor is equal to or more than the target temperature.

Temperature Control of Fixing Apparatus According to the Present Embodiment

Figure 7:
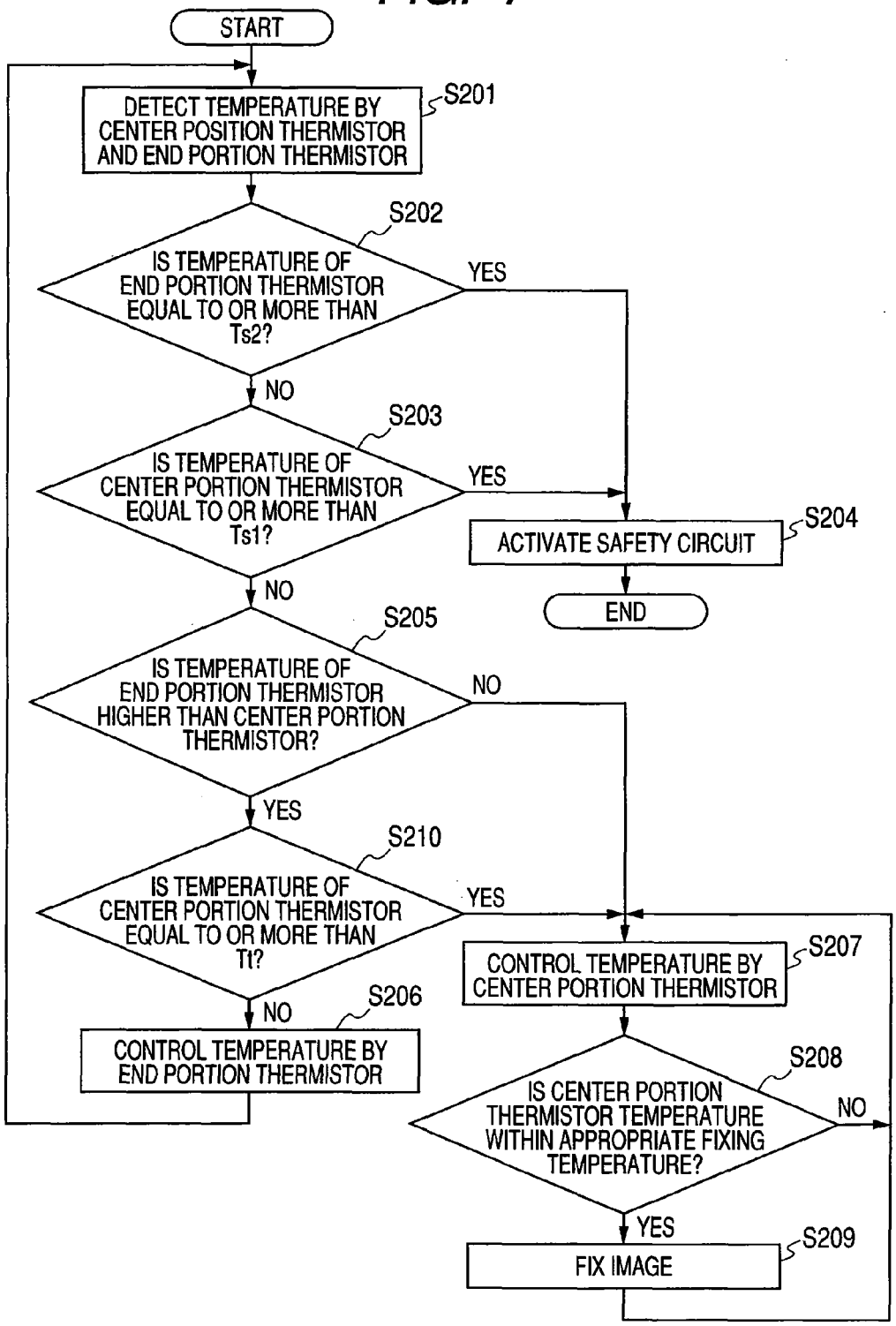
FIG. 7 is a flowchart showing a temperature control according to the second embodiment.

FIG. 7 is a flowchart showing print operation control according to the present embodiment. Since the structures of the image forming apparatus and the fixing apparatus F are the same as those of the first embodiment, the description thereof is omitted. In the following explanation, the same elements are denoted by the same reference numerals of FIG. 1 to FIG. 4.

The print operation control is executed by the CPU 301 of the control circuit unit based on the outputs of the center portion thermistor 201 and the end portion thermistor 202.

When the print operation starts, the CPU 301 uses the center portion thermistor 201 and the end portion thermistor 202 to detect the temperatures at the center portion and the end portion of the fixing apparatus F (S201). When the CPU 301 determines that the temperature detected by the end portion thermistor 202 is equal to or more than the safety circuit activation temperature Ts2 (Yes in S202), the CPU 301 activates the safety circuit (not shown) (S204) so as to stop the print operation. On the other hand, when the CPU 301 determines that the temperature detected by the center portion thermistor 201 is equal to or more than the safety circuit activation temperature Ts1 (Yes in S203), the CPU 301 also activates the safety circuit (S204) so as to stop the print operation. The safety circuit is the same as the one described in the first embodiment.

When the CPU 301 determines that the temperature detected by the end portion thermistor 202 is equal to or less than the temperature detected by the center portion thermistor 201 (No in S205), the CPU 301 controls the temperature of the fixing apparatus F based on the temperature detected by the center portion thermistor 201 (S207). In other words, the CPU 301 performs the temperature control by causing the heater drive circuit unit to control power supplied to the fixing heater 200 so as to cause the temperature detected by the center portion thermistor 201 to be the target temperature Tt (S207). When the CPU 301 determines that the temperature detected by the center portion thermistor 201 is within the appropriate fixing temperature range (Yes in S208), the image fixing operation is performed (S209).

When the CPU 301 determines that the temperature detected by the end portion thermistor 202 is higher than the temperature detected by the center portion thermistor 201 (Yes in S205), the program proceeds to the determination of S210. When the CPU 301 determines that the temperature detected by the center portion thermistor 201 is equal to or more than the target temperature Tt (Yes in S210), the CPU 301 controls the temperature of the fixing apparatus F based on the temperature detected by the center portion thermistor 201 (S207). In other words, the CPU 301 proceeds to such temperature control operation as to cause the temperature detected by the center portion thermistor 201 to be the target temperature Tt.

When the CPU 301 determines that the temperature detected by the center portion thermistor 201 is less than the target temperature Tt (No in S210), the CPU 301 controls the temperature of the fixing apparatus F based on the temperature detected by the end portion thermistor 202 (S206). In other words, the CPU 301 performs the temperature control by causing the heater drive circuit unit to control power supplied to the fixing heater 200 so as to cause the temperature detected by the end portion thermistor 202 to be the target temperature Tt (S206).

The other structures are the same as those of the first embodiment.

Figure 8:
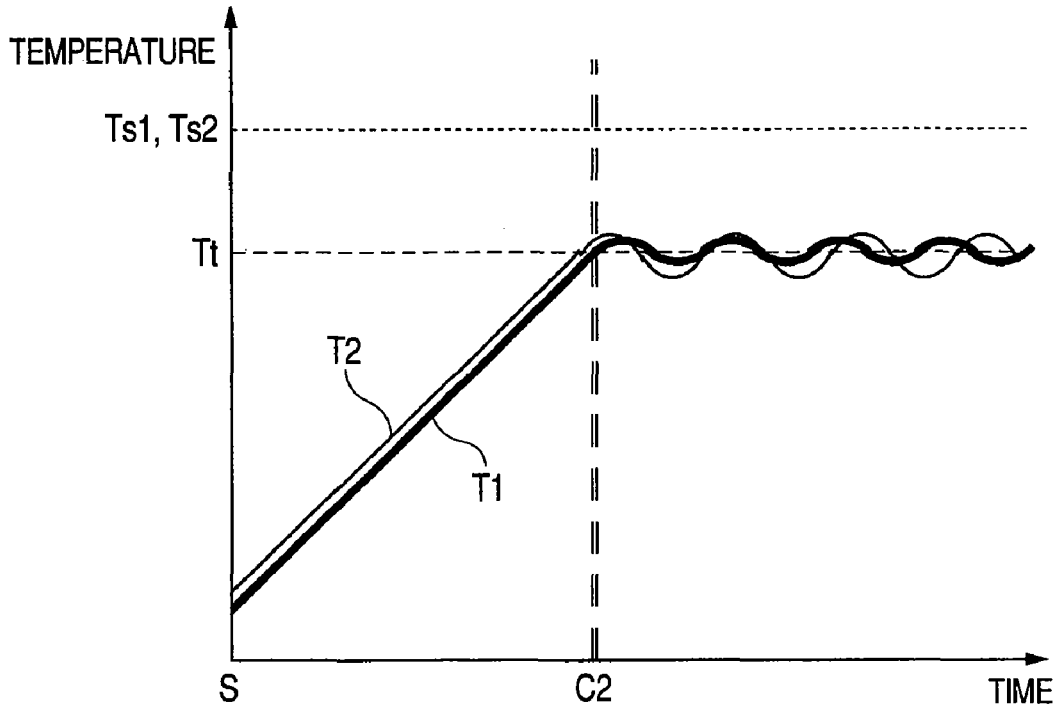
FIG. 8 is a time chart showing the temperature control according to the second embodiment.

Time Chart of Temperature Control of Fixing Apparatus According to the Present Embodiment FIG. 8 is a time chart showing relationship between time and temperatures detected by the center portion thermistor 201 and the end portion thermistor 202 when this control is performed. In FIG. 8, the temperature detected by the center portion thermistor 201 is denoted by T1 (thick solid line), and the temperature detected by the end portion thermistor 202 is denoted by T2 (thin solid line). FIG. 8 shows a case where a small size recording material is fed right before the temperature control according to the print operation shown in this time chart is performed, and at the start of fixing temperature adjustment operation (time S), the temperature T2 detected by the end portion thermistor 202 becomes higher than the temperature T1 detected by the center portion thermistor 201. Since the temperature detected by the end portion thermistor 202 is higher than the temperature detected by the center portion thermistor 201, the CPU 301 performs the temperature control so as to cause the temperature detected by the end portion thermistor 202 to be the target temperature Tt at the start of the temperature control operation. At the position of the time C2, the temperature detected by the center portion thermistor 201 is lower than the temperature detected by the end portion thermistor 202. However, since the temperature detected by the center portion thermistor 201 has reached the target temperature Tt, the CPU 301 switches the temperature control target from the detection result of the end portion thermistor 202 to the detection result of the center portion thermistor 201. At a position after the time C2, the CPU 301 performs the temperature control so as to cause the temperature detected by the center portion thermistor 201 to be the target temperature Tt.

As described above, the present embodiment achieves not only the effects of the first embodiment but also the following effect. When the temperature of the center portion thermistor 201 reaches the target temperature Tt, the CPU 301 proceeds to the control operation for performing the image fixing operation. Therefore, it takes a shorter time to perform the warm-up operation.

Third Embodiment

In the third embodiment, when the temperature control is performed based on the temperature detected by the center portion thermistor, the target temperature is switched.

Temperature Control of Fixing Apparatus According to the Present Embodiment

Figure 9:
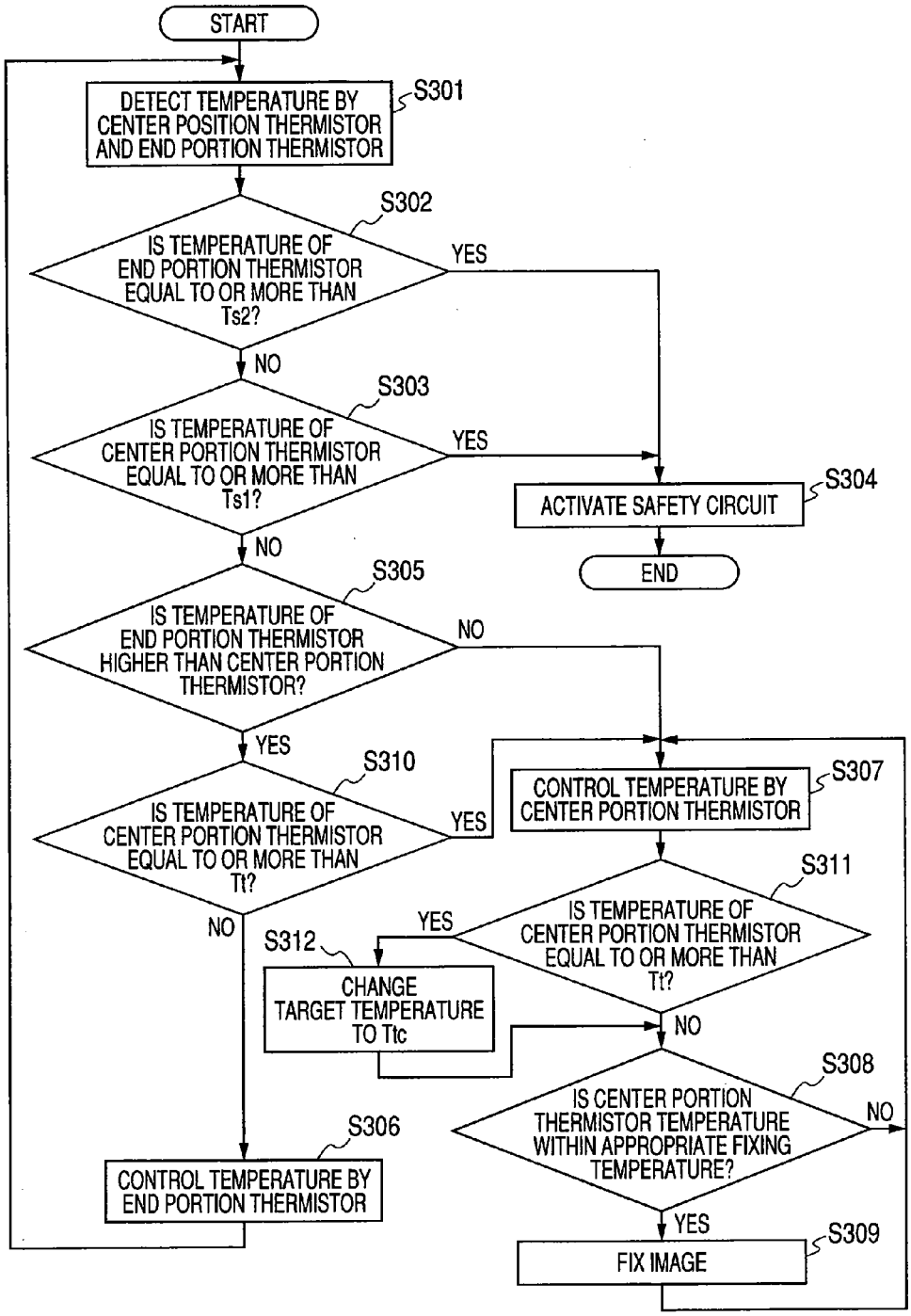
FIG. 9 is a flowchart showing a temperature control according to the third embodiment.

FIG. 9 is a flowchart showing print operation control according to the third embodiment. Since the structures of the image forming apparatus and the fixing apparatus are the same as those of the first embodiment, the description thereof is omitted. In the following explanation, the same elements are denoted by the same reference numerals of FIG. 1 to FIG. 4.

The print operation control is executed by the CPU 301 of the control circuit unit based on the outputs of the center portion thermistor 201 and the end portion thermistor 202.

When the print operation starts, the CPU 301 uses the center portion thermistor 201 and the end portion thermistor 202 to detect the temperatures at the center portion and the end portion (S301). When the CPU 301 determines that the temperature detected by the end portion thermistor 202 is equal to or more than the safety circuit activation temperature Ts2 (Yes in S302), the CPU 301 activates the safety circuit (not shown) (S304) so as to stop the print operation. On the other hand, when the CPU 301 determines that the temperature detected by the center portion thermistor 201 is equal to or more than the safety circuit activation temperature Ts1 (Yes in S303), the CPU 301 also activates the safety circuit (S304) so as to stop the print operation. The safety circuit is the same as the one explained in the first embodiment.

When the CPU 301 determines that the temperature detected by the end portion thermistor 202 is equal to or less than the temperature detected by the center portion thermistor 201 (No in S305), the CPU 301 controls the temperature of the fixing apparatus F based on the temperature detected by the center portion thermistor 201 (S307). In other words, the CPU 301 performs the temperature control by causing the heater drive circuit unit to control power supplied to the fixing heater 200 so as to cause the temperature detected by the center portion thermistor 201 to be the target temperature Tt. When the CPU 301 determines that the temperature detected by the center portion thermistor 201 is within the appropriate fixing temperature range (Yes in S308), the image fixing operation is performed (S309).

In the present embodiment, the CPU 301 performs the following processing after the processing of S307. That is, when the CPU 301 determines that the temperature detected by the center portion thermistor 201 is equal to or more than the target temperature Tt (equal to or more than a predetermined temperature) (Yes in S311), the CPU 301 performs processing for changing the target temperature from Tt to Ttc (S312).

When the CPU 301 determines that the temperature detected by the end portion thermistor 202 is higher than the temperature detected by the center portion thermistor 201 (Yes in S305) and that the temperature detected by the center portion thermistor 201 is equal to or more than the target temperature Tt (Yes in S310), the CPU 301 proceeds to the processing of S307. In other words, the CPU 301 performs the temperature control of the fixing apparatus F based on the temperature detected by the center portion thermistor 201, and proceeds to the temperature control operation so as to cause the temperature detected by the center portion thermistor 201 to be the target temperature Tt (S307).

When the CPU 301 determines that the temperature detected by the center portion thermistor 201 is less than the target temperature Tt (less than the predetermined temperature) (No in S310), the CPU 301 performs the temperature control of the fixing apparatus F based on the temperature detected by the end portion thermistor 202 (S306). In other words, the CPU 301 performs the temperature control by causing the heater drive circuit unit to control power supplied to the fixing heater 200 so as to cause the temperature detected by the end portion thermistor 202 to be the target temperature Tt (S306).

The other structures are the same as those of the second embodiment.

Figure 10:
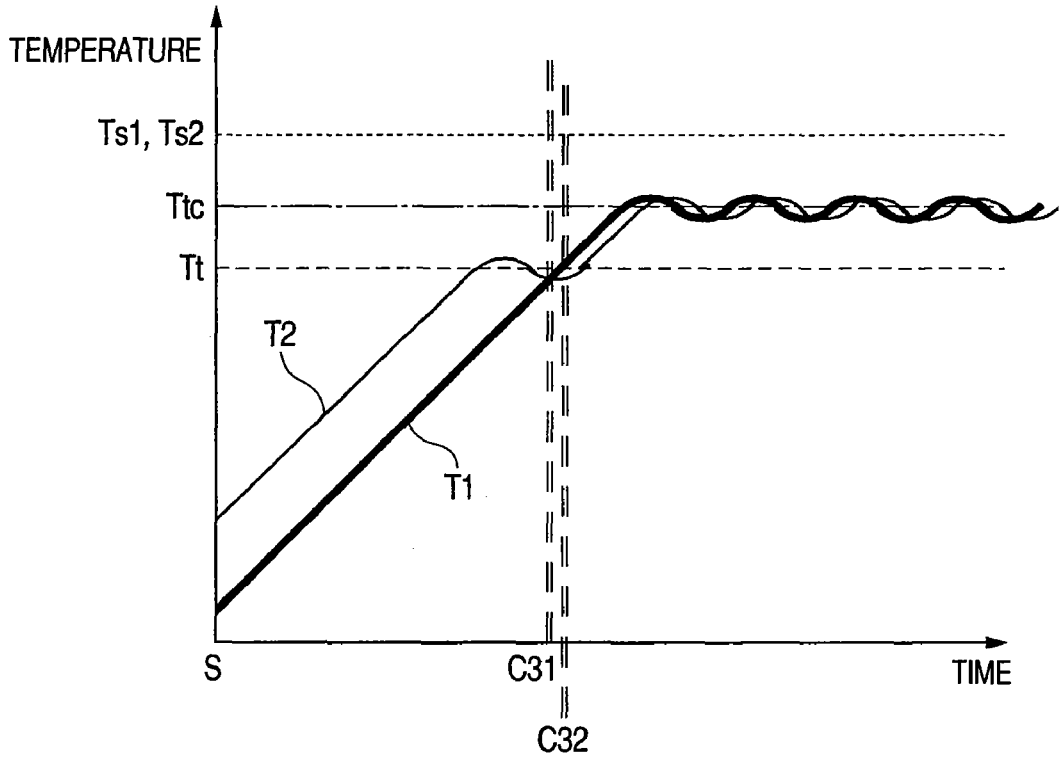
FIG. 10 is a time chart showing the temperature control according to the third embodiment.

Time Chart of Temperature Control of Fixing Apparatus According to the Present Embodiment FIG. 10 is a time chart showing relationship between time and temperatures detected by the center portion thermistor 201 and the end portion thermistor 202 when this control is performed. In FIG. 10, the temperature detected by the center portion thermistor 201 is denoted by T1 (thick solid line), and the temperature detected by the end portion thermistor 202 is denoted by T2 (thin solid line). FIG. 10 shows a case where a small size recording material is fed right before the temperature control according to the print operation shown in this time chart is performed, and at the start of fixing temperature adjustment operation (time S), the temperature T2 detected by the end portion thermistor 202 becomes higher than the temperature T1 detected by the center portion thermistor 201. Since the temperature detected by the end portion thermistor 202 is higher than the temperature detected by the center portion thermistor 201, the CPU 301 performs the temperature control so as to cause the temperature detected by the end portion thermistor 202 to be the target temperature Tt at the start of the temperature control operation. At the position of the time C31, the temperature detected by the center portion thermistor 201 is equal to or more than the temperature detected by the end portion thermistor 202, at which position the CPU 301 switches the temperature control to the one based on the temperature detected by the center portion thermistor 201. At the time C32, the temperature detected by the center portion thermistor 201 reaches the target temperature Tt, and the CPU 301 changes the target temperature from Tt to Ttc different from Tt. At a position after the time C32, the CPU 301 performs the temperature control so as to cause the temperature detected by the center portion thermistor 201 to be the target temperature Ttc.

In FIG. 10, Ttc is a temperature higher than Tt, but Ttc may be a temperature lower than Tt.

In the present embodiment, the CPU 301 performs control for switching the target temperature when the temperature detected by the center portion thermistor 201 reaches the target temperature Tt. This is because there may be a case where the target temperature may be changed to the temperature Ttc appropriate for performing the image fixing operation after the warm-up operation is finished. Accordingly, in the present embodiment, the image fixing operation after the warm-up operation can be carried out with high precision, and it takes a shorter time to perform the warm-up operation.

Fourth Embodiment

In the fourth embodiment, the center portion thermistor is arranged to be in contact with the fixing heater.

Since the structure of the image forming apparatus is the same as that of the first embodiment, the description thereof is omitted. In the following explanation, the same elements are denoted by the same reference numerals of FIG. 1 and FIG. 2. In the present embodiment, however, a later-mentioned center portion thermistor 211 is arranged instead of the center portion thermistor 201 in FIG. 2.

<Structure of Fixing Apparatus>

Figure 11:
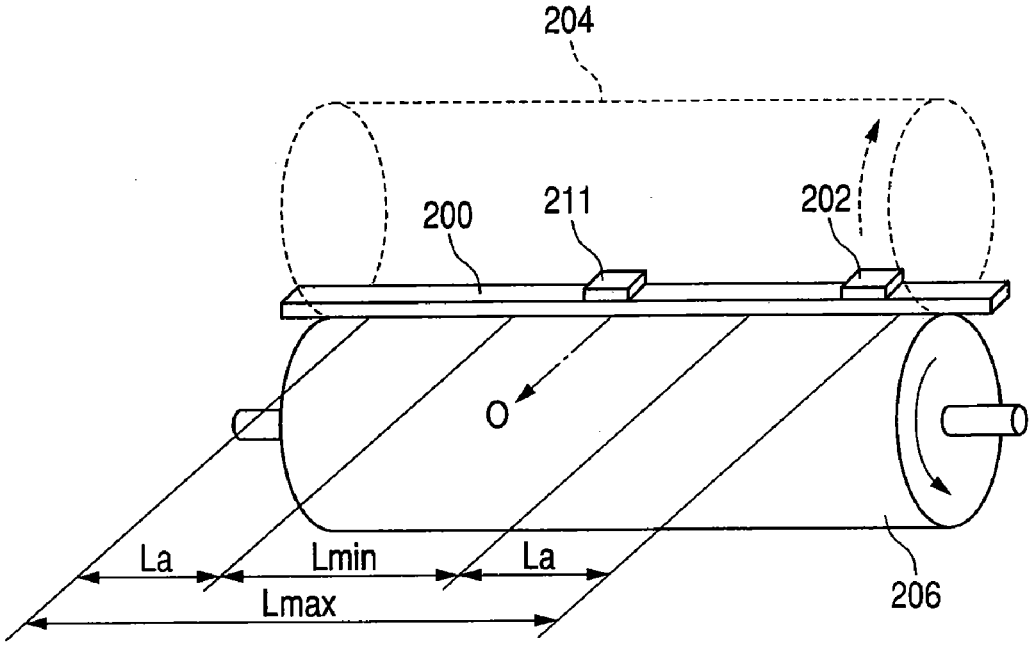
FIG. 11 is a schematic perspective view showing a fixing apparatus according to the fourth embodiment.

FIG. 11 is a perspective view showing an example of structure of the fixing apparatus F according to the fourth embodiment. The fixing apparatus F includes the fixing heater 200 serving as a heat member and the fixing film 204 serving as a heating film sliding on the fixing heater 200. In addition, the fixing apparatus F includes a center portion thermistor 211 serving as a first temperature detection element arranged in contact with the fixing heater 200 and the end portion thermistor 202 serving as the second temperature detection element arranged in contact with the fixing heater 200. The fixing heater 200 is arranged along the longitudinal direction of the fixing heater holder 205 (the direction in parallel with the rotational axis of the fixing film 204) on the lower surface of the fixing heater holder 205. The fixing film 204 is loosely fitted around the fixing heater holder 205. The center portion thermistor 211 and the end portion thermistor 202 are held by the fixing heater holder 205 so as to be in contact with the fixing heater 200.

In the fixing apparatus F according to the present embodiment, the CPU 301 also performs the same control as the temperature control explained in the first to third embodiments.

According to the present embodiment, both of the center portion thermistor 211 and the end portion thermistor 202 are in contact with the fixing heater 200. Even in this configuration, the non-sheet-feeding portion temperature rise can be reduced during the warm-up operation, and in addition, it is possible to reduce the time needed for the warm-up operation and to improve the accuracy of the image fixing operation.

Fifth Embodiment

In the fifth embodiment, the image forming apparatus includes a fixing apparatus of roller fixing type.

Since the structure of the image forming apparatus is the same as that of the first embodiment, the description thereof is omitted. In the following explanation, the same elements are denoted by the same reference numerals of FIG. 1 and FIG. 2. In the present embodiment, however, in FIG. 2, a later-mentioned heating roller 220 is arranged instead of the heater 200, a later-mentioned center portion thermistor 221 is arranged instead of the center portion thermistor 201, and a later-mentioned end portion thermistor 222 is arranged instead of the end portion thermistor 202.

<Structure of Fixing Apparatus>

Figure 12:
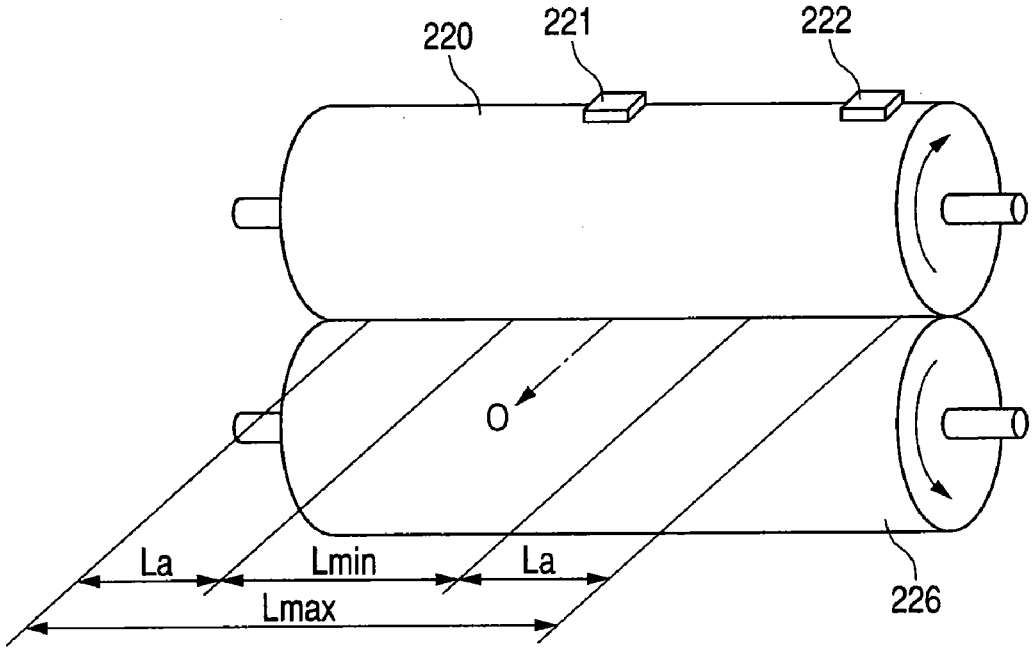
FIG. 12 is a schematic perspective view showing a fixing apparatus according to the fifth embodiment.
Figure 13:
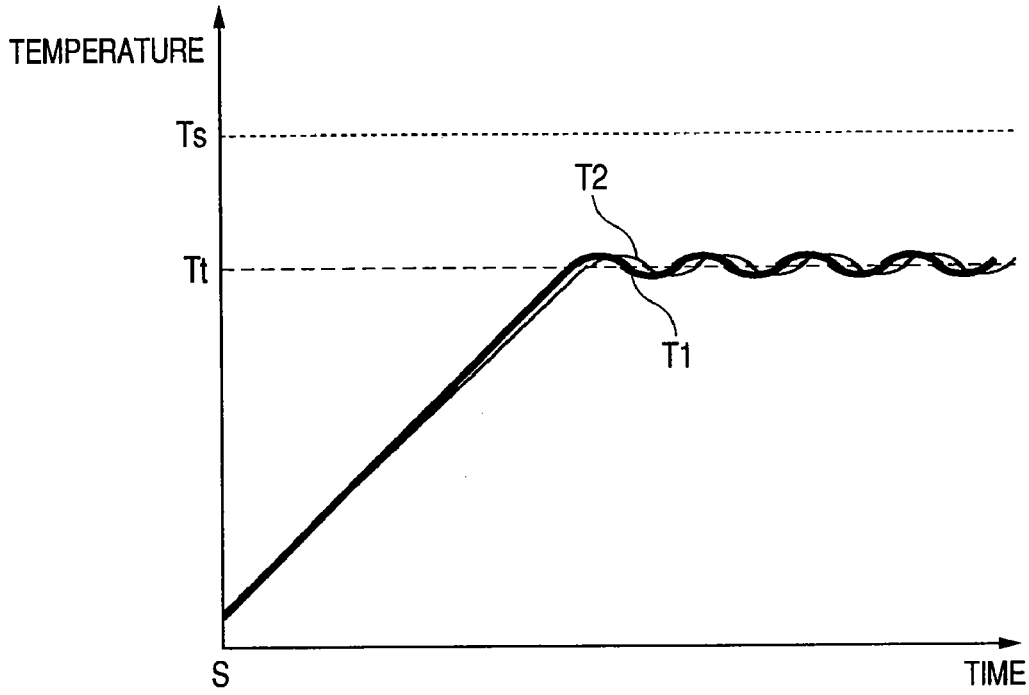
FIG. 13 is a time chart showing a temperature control according to a comparative example.

FIG. 12 is a perspective view showing an example of structure of the fixing apparatus F according to the present embodiment. The fixing apparatus F is of roller fixing type, which is often employed by a fast printer and a copier.

The fixing apparatus F includes a heating roller 220 serving as a heat member, a center portion thermistor 221 serving as a first temperature detection element arranged in contact with the heating roller 220, and an end portion thermistor 222 serving as a second temperature detection element arranged in contact with the heating roller 220. The heating roller 220 includes a heater (not shown) serving as a heat source for heating the heating roller 220, and a heater drive circuit unit (not shown) controls supply of power to the heater. Numeral 226 denotes a pressure roller.

In the fixing apparatus F according to the present embodiment, the CPU 301 also performs the same control as the temperature control described in the first to third embodiments.

According to the present embodiment, both of the center portion thermistor 221 and the end portion thermistor 222 are in contact with the heating roller 220. Even in this configuration, the non-sheet-feeding portion temperature rise can be reduced during the warm-up operation, and in addition, it is possible to reduce the time needed for the warm-up operation and to improve the accuracy of the image fixing operation.

Other Embodiments

In the first to fifth embodiments, the fixing apparatus for heating and fixing an unfixed image onto a recording material as a permanent image has been described as an example. However, the present invention may also be applied to an apparatus for temporarily fixing an unfixed image onto a recording material and an apparatus for improving the quality of the surface nature of image such as gloss by reheating a recording material carrying an image thereon.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-100762, filed Apr. 17, 2009, which is hereby incorporated by reference herein in its entirety.

What is claimed is:

1. An image heating apparatus comprising:

a heat member that heats an image on a recording material;

a pressure member that forms a nip portion for pinching and conveying the recording material with the heat member;

a first temperature detection element that detects a temperature of the heat member in a region for feeding a recording material having the smallest size which can be used by the image heating apparatus, in a direction perpendicular to a conveyance direction of the recording material;

a second temperature detection element that detects a temperature of the heat member in a region outside of the region for feeding the recording material having the smallest size in the direction perpendicular to the conveyance direction of the recording material; and a control part that controls power supplied to the heat member, wherein in a heat process period in which the image is heated by the nip portion, the control part controls the power supplied to the heat member such that a temperature detected by the first temperature detection element keeps a target temperature, wherein in a warm-up period in which the power is supplied to the heat member so that the temperature of the heat member reaches the target temperature, in a case where the temperature detected by the second temperature detection element is higher than the temperature detected by the first temperature detection element, the control part controls the power supplied to the heat member so that the temperature detected by the second temperature detection element reaches the target temperature, and until the temperature detected by the first temperature detection element reaches the target temperature after the temperature detected by the second temperature detection element reaches the target temperature, the control part controls the power supplied to the heat member so that the temperature detected by the second temperature detection element keeps the target temperature.

2. An image heating apparatus according to claim 1, wherein the heat member includes a heating film and a heater arranged in contact with an inner surface of the heating film, and the nip portion is formed by the heater and the pressure member via the heating film.

* * * * *